US012576324B2

(12) United States Patent
Lapicki et al.

(10) Patent No.: US 12,576,324 B2
(45) Date of Patent: Mar. 17, 2026

(54) SHOCK ABSORBING DEFORMABLE SPORTING SUPPORT APPARATUS

(71) Applicants: Walter Lapicki, Lebanon, NJ (US); Jennifer Lapicki, Lebanon, NJ (US)

(72) Inventors: Walter Lapicki, Lebanon, NJ (US); Jennifer Lapicki, Lebanon, NJ (US); Zachary Bergeson, Fond du Lac, WI (US)

( * ) Notice: Subject to any disclaimer, the term of this patent is extended or adjusted under 35 U.S.C. 154(b) by 307 days.

(21) Appl. No.: 18/357,628

(22) Filed: Jul. 24, 2023

(65) Prior Publication Data

US 2025/0032877 A1 Jan. 30, 2025

(51) Int. Cl.
*A63B 69/36* (2006.01)
*A63B 63/00* (2006.01)
*A63B 69/00* (2006.01)

(52) U.S. Cl.
CPC ..... *A63B 69/0002* (2013.01); *A63B 63/00* (2013.01); *A63B 2069/0006* (2013.01)

(58) Field of Classification Search
CPC ..... A63B 69/0002; A63B 63/00; A63B 2069/0006; A63B 71/022; A63B 71/023; A63B 2071/025; A63B 2071/026; A63B 2210/50
USPC ..... 473/197, 431, 434, 435, 454
See application file for complete search history.

(56) References Cited

U.S. PATENT DOCUMENTS

| | | | | | |
|---|---|---|---|---|---|
| 3,427,026 | A * | 2/1969 | Mahoney | A63B 69/0097 | 273/395 |
| 4,960,284 | A * | 10/1990 | Stude | A63B 69/0097 | 473/435 |
| 5,772,537 | A * | 6/1998 | Anderson | A63B 69/0097 | 273/396 |
| 5,857,928 | A * | 1/1999 | Stewart | A63B 71/0054 | 273/400 |
| 6,935,971 | B2 * | 8/2005 | Piras | A63B 69/002 | 473/422 |
| 7,056,241 | B1 * | 6/2006 | Ishino | A63B 69/0095 | 473/473 |
| 2004/0014537 | A1 * | 1/2004 | Piras | A63B 69/0097 | 473/435 |
| 2021/0316199 | A1 * | 10/2021 | Coulter | A63B 69/0097 | |

* cited by examiner

*Primary Examiner* — Nini F Legesse
(74) *Attorney, Agent, or Firm* — Fox Rothschild LLP

(57) ABSTRACT

A deformable sporting support apparatus is provided. The deformable sporting support apparatus may comprise a plurality of support posts, a base component coupled to the plurality of support posts, and, for each support post of the plurality of support posts, a suspension mechanism coupled to the support post and the base component. The suspension mechanism may be configured to enable the support post to deflect up to a maximum deflected angle between the base component and the support post upon an object impacting the support post.

20 Claims, 5 Drawing Sheets

SHOCK ABSORBING DEFORMABLE SPORTING SUPPORT APPARATUS

TECHNOLOGICAL FIELD

The present invention relates generally to pitching aids and, in particular, to pitch training aids incorporating suspension mechanisms for enabling one or more support posts to deform upon collision of a support post with an object (e.g., a sports ball).

BACKGROUND

Pitch training apparatuses generally include targets and/or guiding mechanisms configured and positioned to train a pitcher to be able to pitch a sports ball (e.g., a baseball, softball, etc.) within a designated strike zone for a batter. Pitch training apparatuses may comprise a plurality of posts configured for mounting one or more targets, nets, etc., and are not configured to collision with a sports ball. These support posts, when collided with by the sports ball, may become damaged, may cause the pitch training apparatus to flip, and may cause the sports ball to dangerously deflect, possibly causing injury and/or property damage.

In view of the above, a pitch training apparatus with one or more support posts having a suspension mechanism, enabling the one or more support posts to absorb some or all of the energy resulting from a collision with a sports ball is needed.

BRIEF SUMMARY

According to an object of the present disclosure, a deformable sporting support apparatus is provided. The deformable sporting support apparatus may comprise a plurality of support posts, a base component coupled to the plurality of support posts, and, for each support post of the plurality of support posts, a suspension mechanism coupled to the support post and the base component. The suspension mechanism may be configured to enable the support post to deflect up to a maximum deflected angle between the base component and the support post upon an object impacting the support post.

According to various embodiments, the suspension mechanism may be configured to maintain a standard angle between the base component and the support post.

According to various embodiments, the suspension mechanism may be configured to adjust a position of the support post relative to the base component to maintain the standard angle between the base component and the support post.

According to various embodiments, the standard angle may be approximately 90 degrees.

According to various embodiments, the maximum deflected angle may be approximately 8 degrees.

According to various embodiments, the base component may comprise one or more leg components, wherein a leg component may be coupled to each support post of the plurality of support posts.

According to various embodiments, the one or more leg components may comprise one or more extension members configured to expand and contract, altering a length of the one or more leg components.

According to various embodiments, the suspension mechanism may be coupled to an extension member, of the one or more extension members.

According to various embodiments, the deformable sporting support apparatus may comprise one or more wheels, coupled to at least one of the one or more leg components.

According to various embodiments, the deformable sporting support apparatus may comprise a bracing member configured to maintain a distance between the plurality of support posts.

According to various embodiments, the bracing member may comprise a hinged component configured to enable the bracing member to fold into a folded position.

According to various embodiments, the bracing member may comprise a locking mechanism configured to lock bracing member in an open position wherein, in the open position, the bracing member is configured to maintain the distance between the plurality of support posts.

According to various embodiments, the bracing member may be coupled to the base component.

According to various embodiments, the bracing member may be coupled to each of the plurality of support posts.

According to various embodiments, the suspension mechanism may comprise a spring mechanism configured to absorb impact force when the object impacts the support post.

According to various embodiments, the suspension mechanism may comprise a hydraulic suspension system configured to absorb impact force when the object impacts the support post.

According to various embodiments, one or more of the plurality of support posts may have an adjustable height.

According to various embodiments, the suspension mechanism may be pivotally coupled to the support post.

According to various embodiments, the deformable sporting support apparatus may further comprise a barrier, positioned between the plurality of support posts, configured to prevent a sports ball from passing through the barrier when the sports ball comes into contact with the barrier.

According to various embodiments, the deformable sporting support apparatus may further comprise one or more securing mechanisms coupled to the plurality of support posts. The barrier may be secured to each of the plurality of support posts via the one or more securing mechanisms.

BRIEF DESCRIPTION OF THE DRAWING

Figure 1:
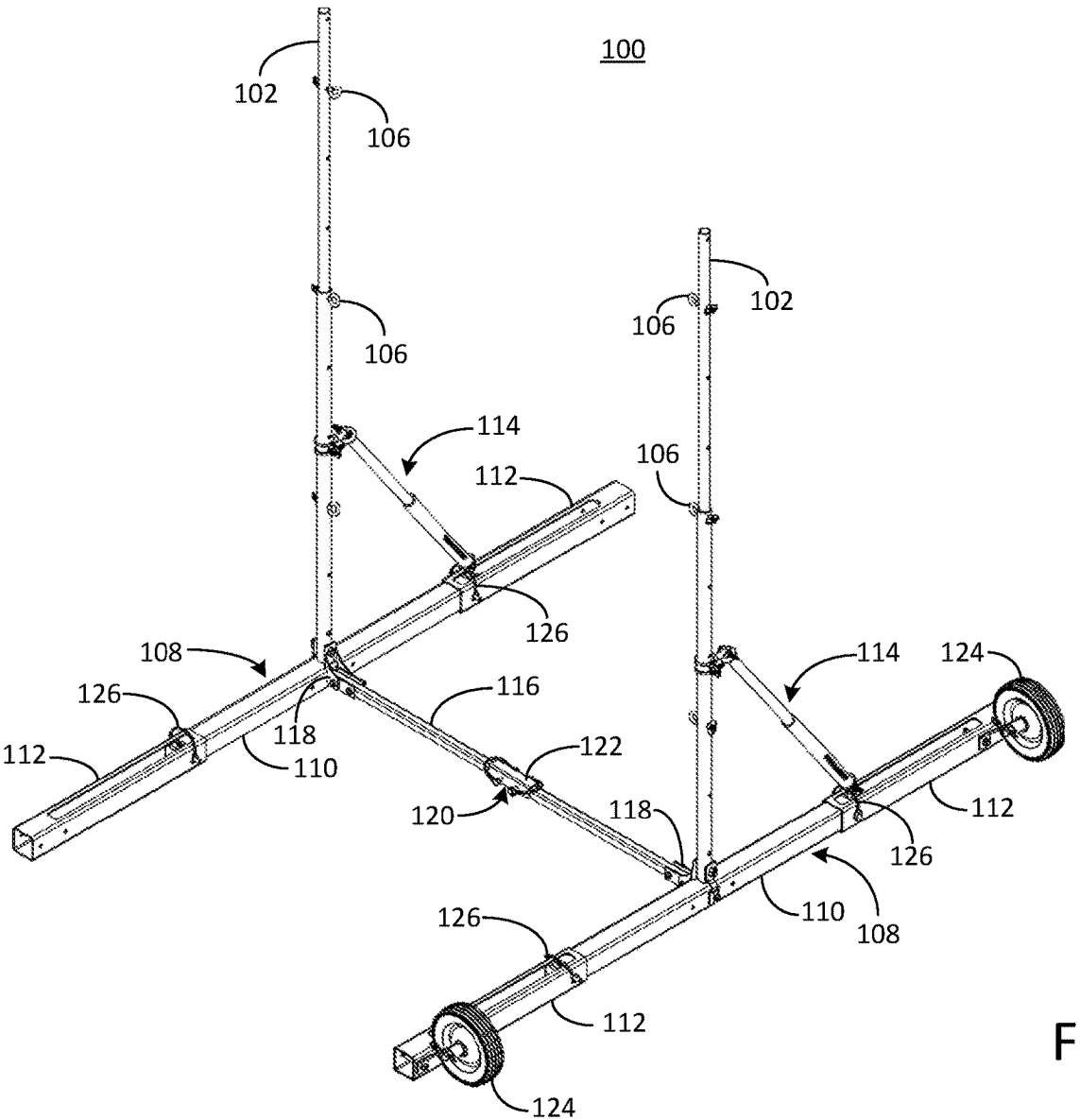
Figure 2:
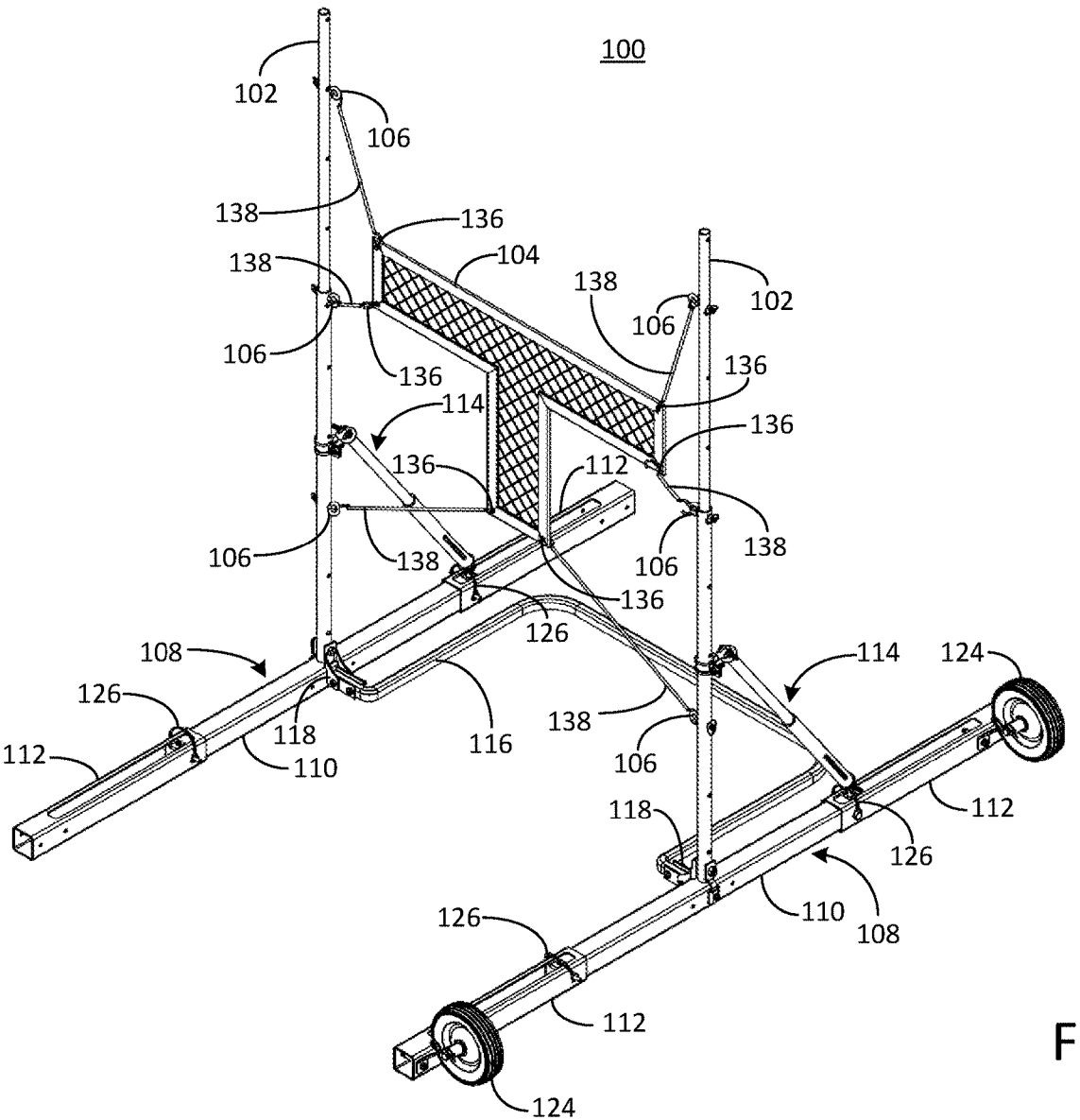
Figure 3:
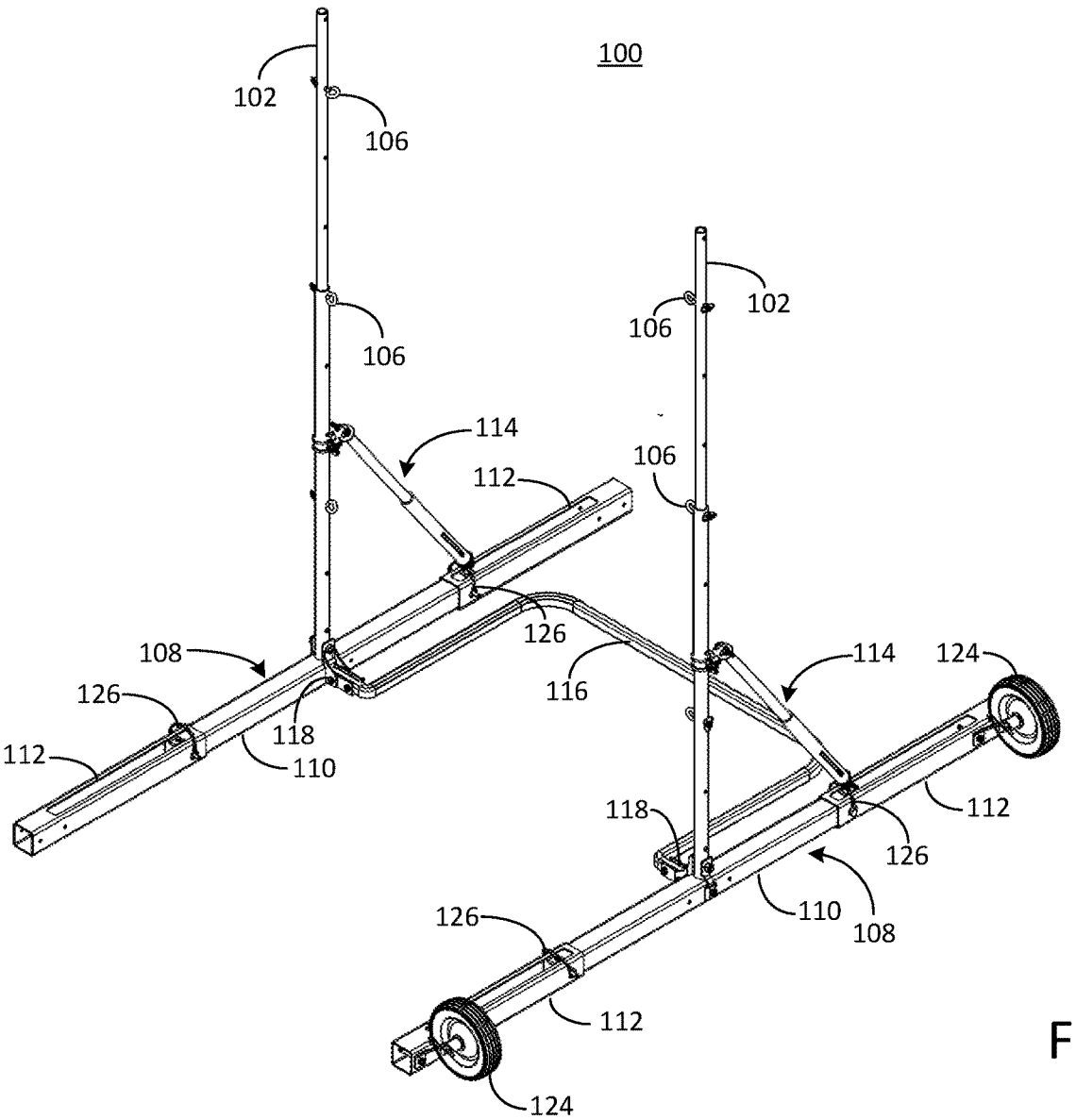
Figure 4:
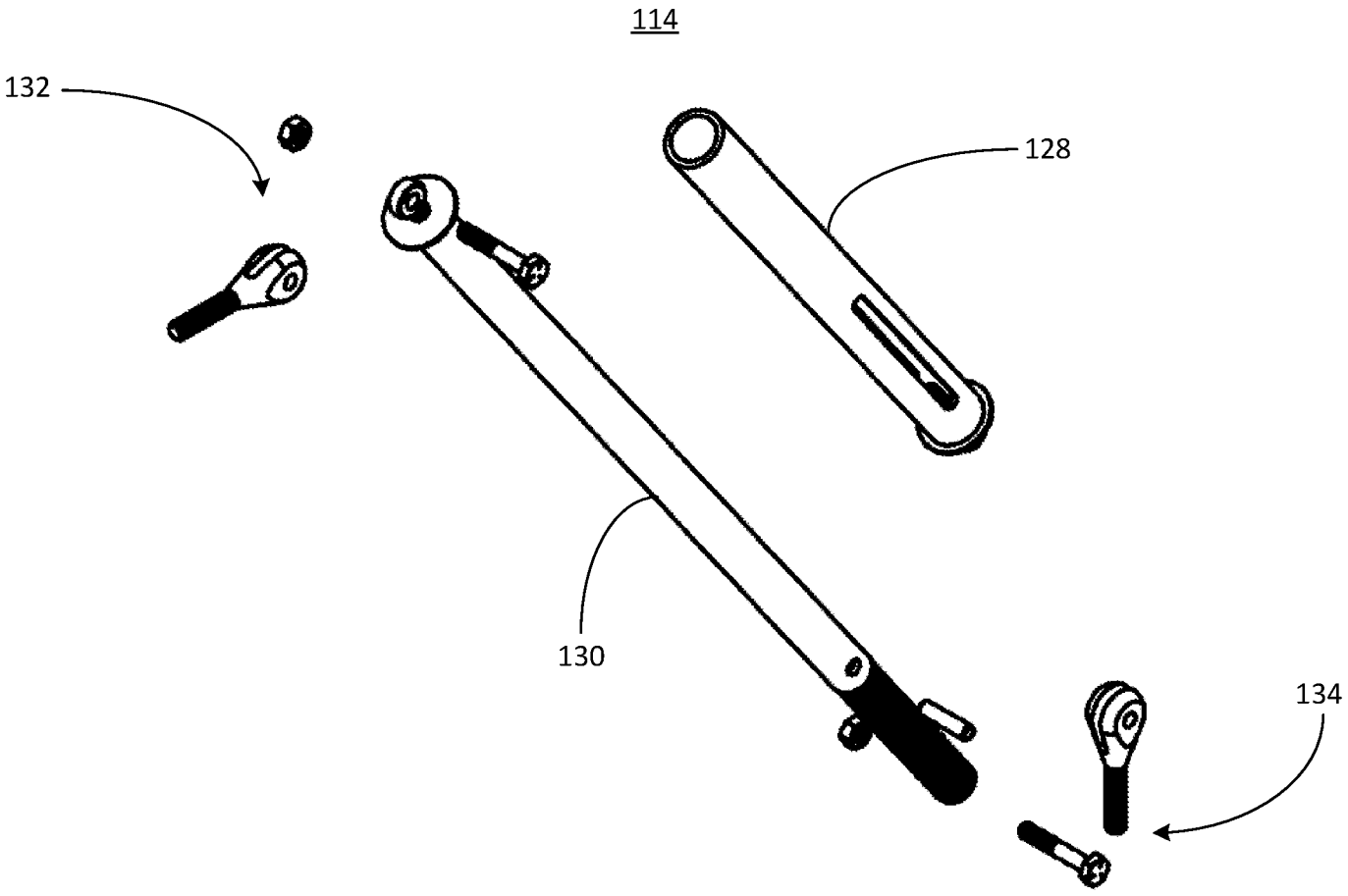
Figure 5:
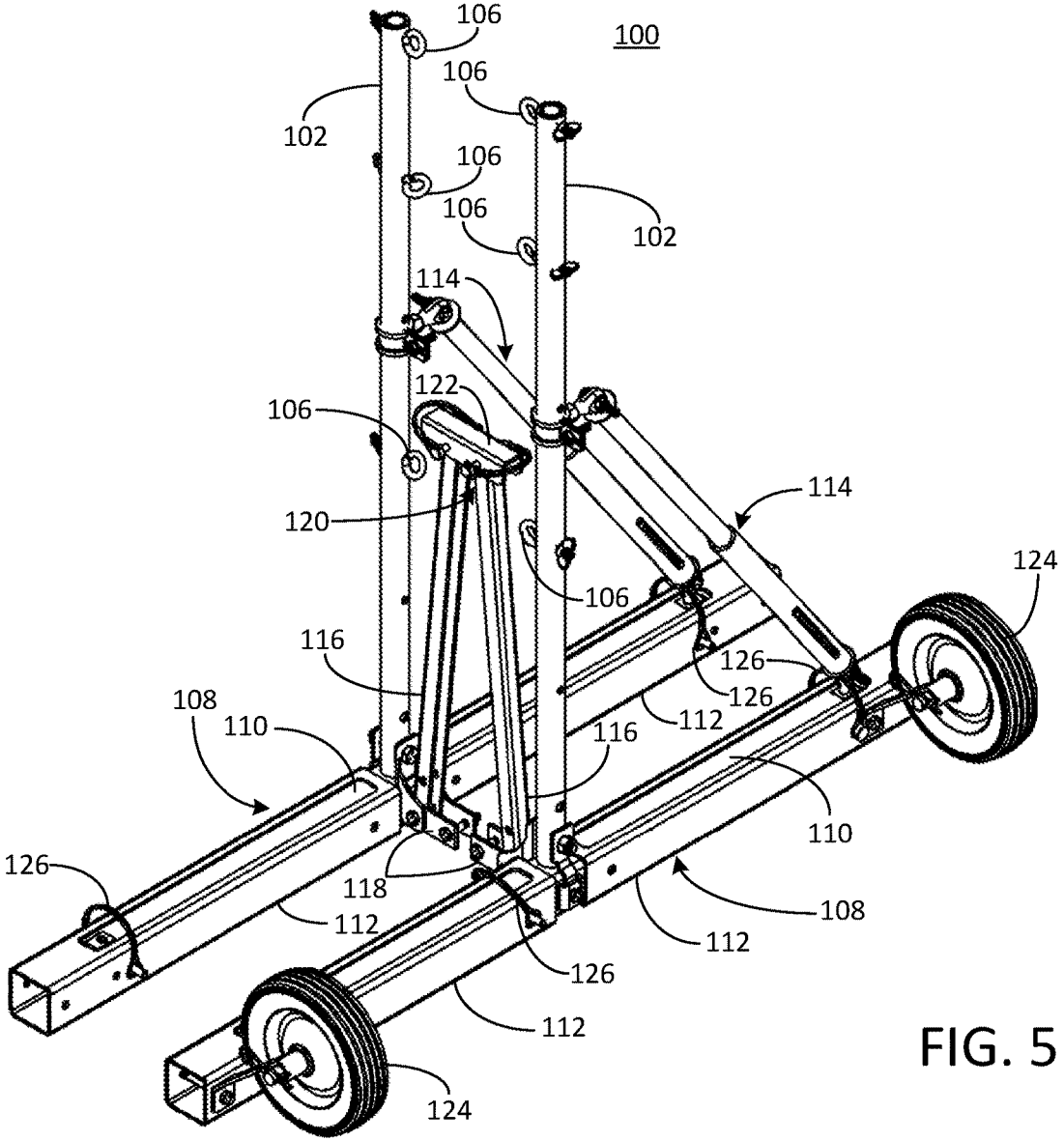

Having thus described example implementations of the disclosure in general terms, reference will now be made to the accompanying drawings, which are not necessarily drawn to scale, and wherein:

FIG. 1 is a perspective view of a deformable sporting support apparatus, according to various embodiments of the present disclosure;

FIG. 2 is a perspective view of a deformable sporting support apparatus with a barrier mounted thereon, according to various embodiments of the present disclosure;

FIG. 3 is a perspective view of a deformable sporting support apparatus, according to various embodiments of the present disclosure;

FIG. 4 is an exploded view of a suspension mechanism of a deformable sporting support apparatus, according to various embodiments of the present disclosure; and FIG. 5 is a perspective view of a deformable sporting support apparatus in a collapsed configuration, according to various embodiments of the present disclosure.

Each figure shown in this disclosure shows a variation of the embodiments presented, and only differences will be discussed in detail.

DETAILED DESCRIPTION

Some implementations of the present disclosure will now be described more fully hereinafter with reference to the accompanying drawings, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Also, something may be shown or described as being to a first, second, third, or the like should not be taken to imply a specific order, unless otherwise stated. Further, although reference may be made herein to a number of measures, predetermined thresholds and the like such as dollar amounts, units, percentages and the like, according to which aspects of example implementations may operate; unless stated otherwise, any or all of the measures/predetermined thresholds may be configurable. Like reference numerals refer to like elements throughout.

Example implementations of the present disclosure are generally directed to deformable sporting support apparatuses for training a user to aim a sports ball (e.g., a baseball, softball, lacrosse ball, football, tennis ball, ping pong ball, soccer ball, etc.). Example implementations will be primarily described in the context of pitch training systems and apparatuses for use with baseballs and softballs. It should be understood, however, that example implementations may be equally applicable to any of a number of other projectiles such as, e.g., footballs, ping pong balls, tennis balls, and the like. It is to be understood that, as used herein, "sports ball" could include any suitable targeted projectile for use in sports.

Referring now to FIGS. 1-3, perspective views of deformable sporting support apparatuses 100 are illustratively depicted.

According to various embodiments, the deformable sporting support apparatus 100 may comprise a plurality of support posts 102. The plurality of support posts 102 may be configured to secure a barrier 104 therebetween (as shown, e.g., in FIG. 2). According to various embodiments, one or more of the plurality of support posts 102 may be cylindrical in shape, have a circular, triangular, and/or rectangular cross-section, and/or have another suitable shape. The deformable sporting support apparatus 100, as depicted in FIGS. 1-3 and 5, comprises two support posts 102. It is noted, however, that other quantities of support posts 102 may be incorporated as needed.

According to various embodiments, one or more of the plurality of support posts 102 may have a set height. According to various embodiments, one or more of the plurality of support posts 102 may have an adjustable height. According to various embodiments, one or more of the plurality of support posts 102 may be a telescoping support post 102 (as shown, e.g., in FIGS. 1-3).

According to various embodiments, the barrier 104 may be secured to the deformable sporting support apparatus 100 between the plurality of support posts 102. The barrier 104 may be configured to prevent an object (e.g., a sports ball) from passing through the barrier 104 when the sports ball comes into contact with the barrier 104 such as, e.g., when the sports ball is pitched/thrown toward the barrier 104. The barrier 104 may comprise one or more materials and/or configurations of materials suitable for preventing the sports ball from passing through the barrier 104. For example, the barrier 104 may comprise plastic, fiber, rope, rubber, wood, glass, metal, and/or other suitable materials. Some or all of the barrier 104 may be in the form of netting configured to receive the sports ball when the sports ball comes into contact with the barrier 104.

According to various embodiments, the deformable sporting support apparatus 100 may comprise one or more securing mechanisms 138 configured to secure the barrier 104 to one or more securing points 106 (e.g., hooks, loops, etc.) of the plurality of support posts 102. According to various embodiments, the barrier 104 may be secured to each of the plurality of support posts 102 via the one or more securing mechanisms 138. According to various embodiments, the one or more securing points 106 may be configured to be repositionable along the plurality of support posts 102.

According to various embodiments, the one or more securing mechanisms 138 may comprise one or more structures for causing the barrier 104 to be taut between the plurality of support posts 102. For example, the securing mechanisms 138 may comprise one or more elastic bands configured to be secured to both the barrier 104 and the support posts 102, causing the barrier 104 to be stretched taut between the support posts 104, enabling the position of the barrier 104 between the support posts 104 to be maintained. It is noted, however, that other suitable securing mechanisms 138 may be incorporated, while maintaining the spirit and functionality of the present disclosure. For example, the securing mechanisms 138 may comprise rope, wire, chain, and/or other suitable securing mechanisms 138 for securing the barrier 104 taut between the support posts 102. According to various embodiments, the tautness of the barrier 104 between the support posts 102 may be aided by the support posts 102 being maintained at a set distance apart from each other.

According to various embodiments, the barrier 104 may comprise a plurality of connection points 136 configured for securing the one or more securing mechanisms 138 to the barrier 104, enabling the barrier 104 to be coupled to the support posts 102 via the one or more securing mechanisms 138 being coupled to the connection points 136 of the support posts 102 and the connection points 136 of the barrier 104.

According to various embodiments, the set distance between the support posts 102 may be maintained via one or more bracing members 116. The bracing member 116 may be coupled to the base component 108 and/or one or more of the plurality of support posts 102. As shown in FIGS. 1-2, the bracing member 116 may be coupled to the plurality of leg components 110 and the plurality of support posts 102. It is noted, however, that other configurations may also be incorporated, while maintaining the spirit and functionality of the present disclosure. For example, the bracing member 116 may be coupled solely to the leg components 110 and not to the support posts 102 or supported solely to the support posts 102 and not to the leg components 110. According to various embodiments, the bracing member 116 may be positioned along any suitable portion of the base component 108, may have any suitable shape (e.g., the U-shape as shown in FIG. 3) suitable for maintaining a distance between the support posts 102.

The bracing member 116 may be coupled to the support posts 102 and/or the base component 108 via one or more bracket components 118. According to various embodiments, when the bracing member 116 is coupled to one or more of the plurality of support posts 102, the bracket member 118 is configured to enable the support post 102 to rotate about the bracket member 118.

According to various embodiments, the deformable sporting support apparatus 100 may comprise a base component 108. The base component 108 may be coupled to the plurality of support posts 102. According to various embodiments, the base component 108 may comprise one or more leg components 110. According to various embodiments, as shown in FIGS. 1-3, the leg components 110 may be coupled to each support post 102 of the plurality of support posts 102.

According to various embodiments, the one or more leg components 110 may have set dimensions. According to various embodiments, the one or more leg components 110 may have one or more adjustable dimensions. For example, the one or more leg components 110 may comprise one or more extension members 112 configured to expand and contract, altering a length of the one or more leg components 110. According to various embodiments, the leg components 110 may comprise one or more locking mechanisms 126 configured to secure the one or more extension members 112 in an expanded and/or retracted position.

According to various embodiments, the deformable sporting support apparatus 110 may comprise one or more suspension mechanisms 114. According to various embodiments, for each support post 102 of the plurality of support posts 102, a suspension mechanism 114 may be coupled to the support post 102 and the base component 108.

According to various embodiments, for each support post 102, the one or more suspension mechanisms 114 may be configured to enable the support post 102 to deflect up to a maximum deflected angle between the base component 108 and the support post 102 upon an object impacting the support post 102. According to various embodiments, the maximum deflected angle may be under 10 degrees. According to various embodiments, the maximum deflected angle may be approximately 8 degrees. It is noted, however, that other suitable maximum deflection angles (e.g., greater than or less than 10 degrees) may be incorporated while maintaining the spirit and functionality of the present disclosure.

By enabling the support posts 102 to deflect upon impact with an object (e.g., a sports ball), the suspension mechanisms 114 enable some of the energy of the impact with the sports ball to be absorbed by the suspension mechanism 114, decreasing a speed at which the sports ball may deflect/bounce off of the support posts 102, decreasing the risk of injury upon contact with the deflected sports ball. Furthermore, by enabling the support posts 102 to deflect upon impact with an object (e.g., a sports ball), the suspension mechanisms 114 may decrease the risk of damage to the support posts 102 following an impact between the support post(s) 102 and a sports ball since the support posts 102 maintain an ability for motion upon impact.

According to various embodiments, the suspension mechanism 114 may be configured to maintain a standard angle between the base component 108 and the support post 102. As shown in FIGS. 1-3, the standard angle between the base component 108 and the support post 102 is approximately 90 degrees. It is noted, however, that other standard angles may be incorporated while maintaining the spirit and functionality of the present disclosure. Upon impact between the support post 102 and an object (e.g., a sports ball), the angle between the support post 102 and the base component 108 may be less than the standard angle. According to various embodiments, when the angle between the support post 102 and the base component 108 is less than the standard angle, the suspension mechanism 114 may be configured to adjust a position of the support post 102 relative to the base component 108 to maintain the standard angle between the base component 108 and the support post 102.

According to various embodiments, one or more of the suspension mechanisms 114 may be coupled to a support post 102 enabling the support posts 102 to deflect upon impact with an object (e.g., a sports ball), and a leg component 110. According to various embodiments, the suspension mechanism 114 may be coupled to an extension member 112 of the leg component.

According to various embodiments, the suspension mechanism 114 is configured to absorb impact force when an object (e.g., a sports ball) impacts the support post 102. The suspension mechanism 114 may be a hydraulic suspension mechanism, a spring suspension mechanism (as shown, e.g., in FIG. 4), a torsion suspension mechanism, an air suspension mechanism, and/or other suitable suspension mechanism 114. According to various embodiments, a spring suspension mechanism 114 may comprise, e.g., a tube suspension spring 128 inserted within a tube suspension float 130 and securing mechanisms (e.g., screws, nuts, bolts, etc.) 132, 134 for securing the suspension mechanism 114 to the support post 102 and/or the base component 108. It is noted, however, that other suspension mechanism 114 configurations and/or components may be incorporated while maintaining the spirit and functionality of the present disclosure. According to various embodiments, the suspension mechanism 114 may be pivotally coupled to the support post 102, facilitating movement of the support post 102 upon collision of the support post 102 with an object (e.g., a sports ball).

The deformable sporting support apparatus 100 may be configured to be collapsible for ease of transportation and storage. According to various embodiments, the bracing member 116 may comprise a hinged component 120 configured to enable the bracing member 116 to fold about the hinged component 120 into a folded position, decreasing the distance between the plurality of support posts 102. According to various embodiments, the bracing member 116 may comprise a locking mechanism 122. The locking mechanism 122 may be configured to lock the bracing member 116 in an open position. In the open position, the bracing member 116 may be configured to maintain the distance between the plurality of support posts 102. According to various embodiments, the deformable sporting support apparatus 100 may comprise one or more wheels 124 configured to aid in transportation of the deformable sporting support apparatus in an expanded and/or collapsed configuration. According to various embodiments, the one or more wheels 124 may be coupled to at least one of the one or more leg components 110 (as shown, e.g., in FIGS. 1-3, and 5) and/or on other suitable portions of the deformable sporting support apparatus 100.

Many modifications and other implementations of the disclosure set forth herein will come to mind to one skilled in the art to which these disclosures pertain having the benefit of the teachings presented in the foregoing descriptions and the associated drawings. Therefore, it is to be understood that the disclosure are not to be limited to the specific implementations disclosed and that modifications and other implementations are intended to be included within the scope of this disclosure.

Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A deformable sporting support apparatus, comprising:
a plurality of support posts; and
for each support post of the plurality of support posts:
a base component coupled to the support post; and
a suspension mechanism coupled to the support post and the base component,
wherein:
each support post, of the plurality of support posts, is configured to rotate in relation to its respective base component,
the suspension mechanism is configured to enable the support post to deflect, and
the deflection causes an angle between the base component and the support post to change upon an object impacting the support post.

2. The deformable sporting support apparatus of claim 1, wherein:
the suspension mechanism is configured to maintain a standard angle between the base component and the support post, and
the standard angle is an angle between the base component and the support post prior to the support post being deflected.

3. The deformable sporting support apparatus of claim 2, wherein the suspension mechanism is configured to adjust a position of the support post relative to the base component to maintain the standard angle between the base component and the support post.

4. The deformable sporting support apparatus of claim 2, wherein the standard angle is approximately 90 degrees.

5. The deformable sporting support apparatus of claim 1, wherein the suspension mechanism is configured to enable the angle between the base component and the support post to be deflected to a maximum deflected angle of approximately 8 degrees.

6. The deformable sporting support apparatus of claim 1, wherein the base component comprises one or more leg components, wherein a leg component is coupled to each support post of the plurality of support posts.

7. The deformable sporting support apparatus of claim 6, wherein the one or more leg components comprise one or more extension members configured to expand and contract, altering a length of the one or more leg components.

8. The deformable sporting support apparatus of claim 7, wherein the suspension mechanism is coupled to an extension member, of the one or more extension members.

9. The deformable sporting support apparatus of claim 6, further comprising one or more wheels, coupled to at least one of the one or more leg components.

10. The deformable sporting support apparatus of claim 1, further comprising a bracing member configured to maintain a distance between the plurality of support posts.

11. The deformable sporting support apparatus of claim 10, wherein the bracing member comprises a hinged component configured to enable the bracing member to fold into a folded position.

12. The deformable sporting support apparatus of claim 11, wherein the bracing member comprises a locking mechanism configured to lock bracing member in an open position wherein, in the open position, the bracing member is configured to maintain the distance between the plurality of support posts.

13. The deformable sporting support apparatus of claim 10, wherein the bracing member is coupled to the base component.

14. The deformable sporting support apparatus of claim 10, wherein the bracing member is coupled to each of the plurality of support posts.

15. The deformable sporting support apparatus of claim 1, wherein the suspension mechanism comprises a spring mechanism configured to absorb impact force when the object impacts the support post.

16. The deformable sporting support apparatus of claim 1, wherein the suspension mechanism comprises a hydraulic suspension system configured to absorb impact force when the object impacts the support post.

17. The deformable sporting support apparatus of claim 1, wherein one or more of the plurality of support posts has an adjustable height.

18. The deformable sporting support apparatus of claim 1, wherein the suspension mechanism is pivotally coupled to the support post.

19. The deformable sporting support apparatus of claim 1, further comprising a barrier, positioned between the plurality of support posts, configured to prevent a sports ball from passing through the barrier when the sports ball comes into contact with the barrier.

20. The deformable sporting support apparatus of claim 19, further comprising one or more securing mechanisms coupled to the plurality of support posts,
wherein the barrier is secured to each of the plurality of support posts via the one or more securing mechanisms.

* * * * *